US011278140B2

(12) United States Patent
Greene

(10) Patent No.: US 11,278,140 B2
(45) Date of Patent: Mar. 22, 2022

(54) CARRYING TRAY

(71) Applicant: Elida Leticia Greene, Cary, NC (US)

(72) Inventor: Elida Leticia Greene, Cary, NC (US)

( * ) Notice: Subject to any disclaimer, the term of this patent is extended or adjusted under 35 U.S.C. 154(b) by 1081 days.

(21) Appl. No.: 15/003,965

(22) Filed: Jan. 22, 2016

(65) Prior Publication Data

US 2016/0213182 A1 Jul. 28, 2016

Related U.S. Application Data

(60) Provisional application No. 62/108,107, filed on Jan. 27, 2015.

(51) Int. Cl.
*A47G 23/06* (2006.01)

(52) U.S. Cl.
CPC ..... *A47G 23/06* (2013.01)

(58) Field of Classification Search
CPC ..... A47G 23/06; A47J 47/14; B65D 25/04; B65D 75/52; A63H 33/00
USPC ..... 206/488, 234; 220/553, 500; 446/118
See application file for complete search history.

(56) References Cited

U.S. PATENT DOCUMENTS 3,111,220 A * 11/1963 Bostrom ..... B65D 73/0057 206/462
3,508,183 A 4/1970 Pinckard
3,610,459 A 10/1971 Hanson
4,239,230 A 12/1980 Shoptaugh
4,802,593 A 2/1989 Romanos
4,908,066 A 3/1990 Taylor et al.
5,055,081 A 10/1991 Nayak
5,097,957 A 3/1992 Adams, Jr. et al.
5,269,447 A 12/1993 Gower et al.
5,551,615 A * 9/1996 McIntosh ..... A45F 5/00 224/250
5,586,800 A 12/1996 Triplett
5,676,252 A * 10/1997 Lillelund ..... A47G 19/26 206/551
5,762,245 A 6/1998 Hurst
5,878,672 A 3/1999 Ostermann et al.
5,915,561 A 6/1999 Lorenzana et al.
5,934,472 A * 8/1999 Ramirez ..... B65D 77/003 206/557
5,952,637 A * 9/1999 Strunk ..... A63F 3/0023 16/225
5,975,628 A 11/1999 Russell
6,179,377 B1 1/2001 Harper
6,315,126 B1 11/2001 Cornelissen
7,267,244 B1 9/2007 Dalhamer
7,966,949 B2 * 6/2011 Willey ..... B60N 3/002 108/25
8,006,843 B1 * 8/2011 McFarland ..... B65D 1/34 206/503

(Continued)

*Primary Examiner* — Anthony D Stashick
*Assistant Examiner* — James M Van Buskirk
(74) *Attorney, Agent, or Firm* — Coats & Bennett, PLLC

(57) ABSTRACT

A carrying tray comprises a base having a support surface configured to support food containers and a plurality of pegs. The support surface includes a plurality of peg openings to receive the pegs. To transport food containers, a user places the food containers on the support surface and inserts the pegs into selected ones of the peg openings to prevent the food containers from shifting during transport. The carrying tray is thus able to accommodate food containers of varying size.

5 Claims, 3 Drawing Sheets

(56) References Cited

U.S. PATENT DOCUMENTS

| | | | | |
|---|---|---|---|---|
| 8,381,912 | B2 * | 2/2013 | Dalhamer | B65D 1/34 206/557 |
| 2004/0144683 | A1 | 7/2004 | Wang | |
| 2011/0048988 | A1 * | 3/2011 | Kotula | B25H 3/02 206/372 |
| 2015/0257608 | A1 * | 9/2015 | Torlai | A47J 47/005 269/15 |

* cited by examiner

CARRYING TRAY

RELATED APPLICATIONS

This application claims the benefit of U.S. Provisional Patent Application 62/108,107 filed Jan. 27, 2015, which is incorporated herein by reference.

TECHNICAL FIELD

The present invention relates generally to carrying trays for food containers and, more particularly, to a carrying tray designed to carry food containers of varying sizes.

BACKGROUND

A common problem encountered by many people is how to transport food containers to a social event or gathering, such as a family reunion, without dropping the food containers or spilling food therefrom. One common solution is to pack food containers in boxes for transport. However, a box of appropriate size may not always be available. In this case, a person may attempt to surround the food containers within a box with towels or newspaper to prevent the food container from shifting during transport. Various types of food carriers are also sold which typically come with a food container that fits within the food carrier. Such food carriers are not likely to be suitable for all occasions. There will inevitably be times where a person needs to transport a food container that does not fit within the food carrier.

Accordingly, there remains a need for a food carrier that can transport food containers of arbitrary size without shifting during transport.

SUMMARY

The present invention comprises a carrying tray for transporting food containers or other articles. The carrying tray comprises a base having a support surface configured to support food containers and a plurality of pegs. The support surface includes a plurality of peg openings to receive the pegs. To transport food containers, a user places the food containers on the support surface and inserts the pegs into selected ones of the peg openings to prevent the food containers from shifting during transport. The carrying tray is thus able to accommodate food containers of varying size.

In one embodiment, a storage recess is formed in the support surface for storing the pegs when the carrying tray is not in use. A strap extends across the storage recess to retain the pegs in the storage recess. In one embodiment, the storage recess has a generally rectangular configuration and is centrally located on the support surface. The storage recess may include a finger access extension to allow insertion of a user's fingers to retrieve the storage pegs.

The carrying tray could be used to carry a variety of articles in addition to food containers, such as flower vases, potted plants, or similar articles that can spill during transport.

DETAILED DESCRIPTION

Figure 1:
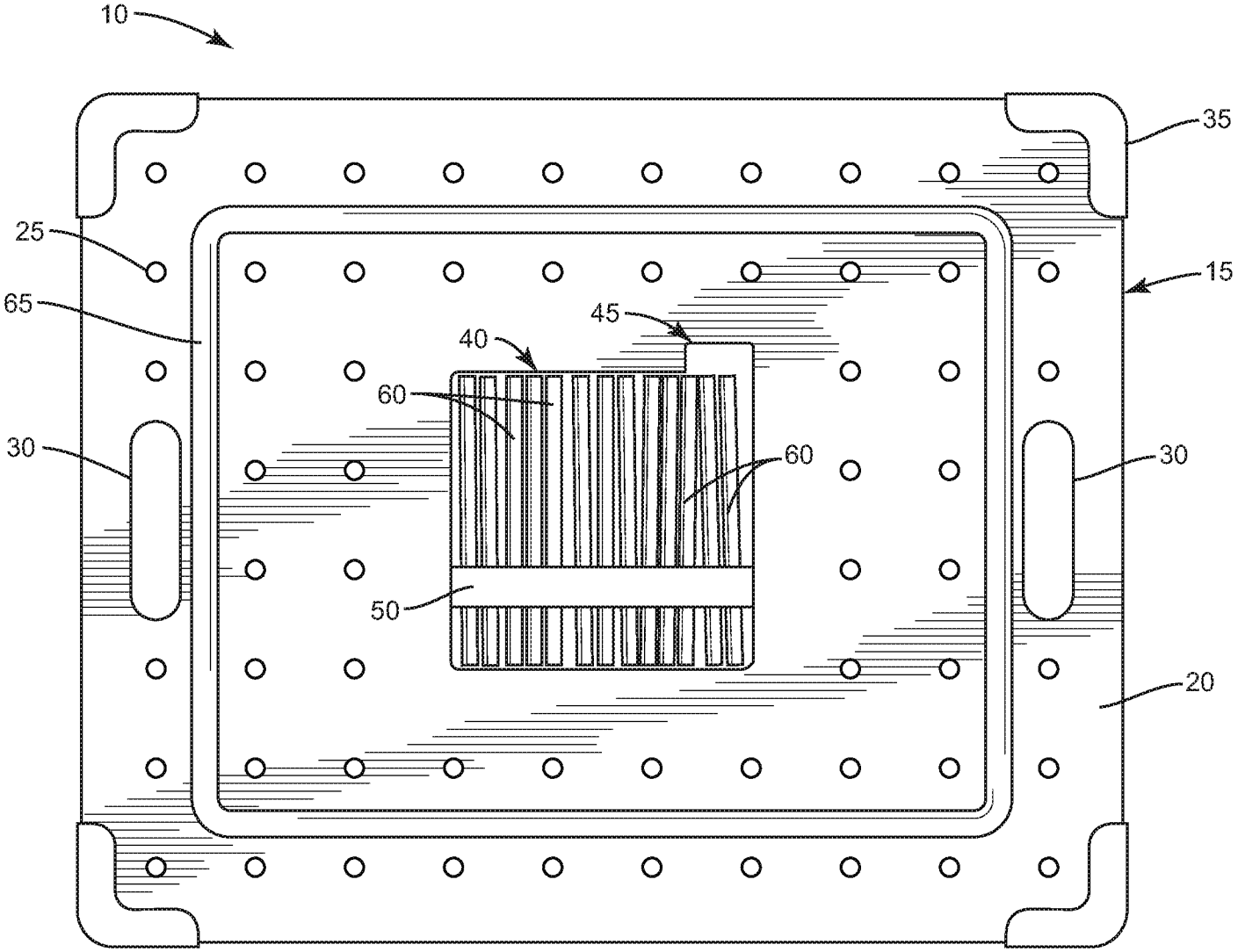
FIG. 1 is a top plan view of the carrying tray according to one embodiment.
Figure 2:
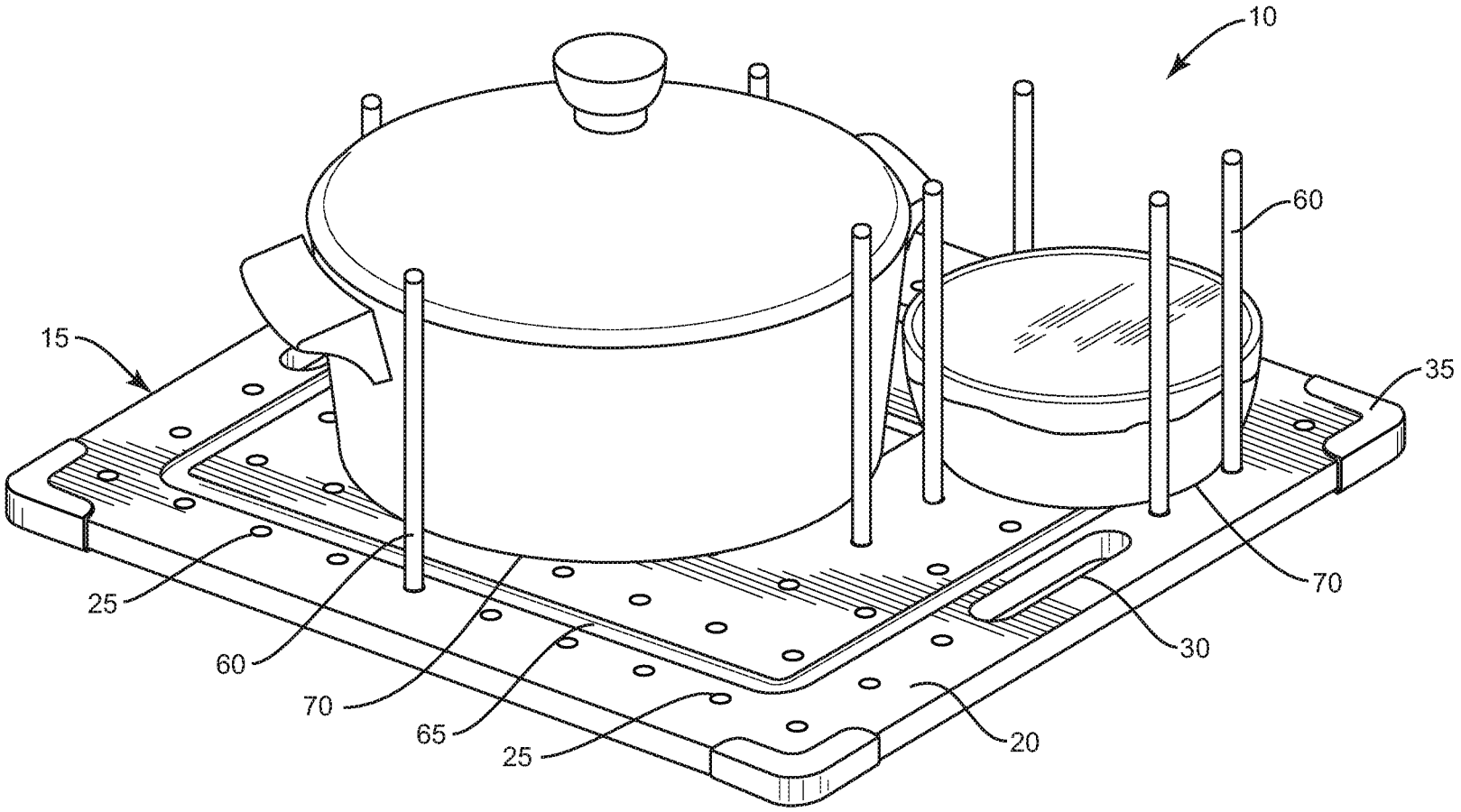
FIG. 2 is a perspective view of the carrying tray in use.
Figure 3:
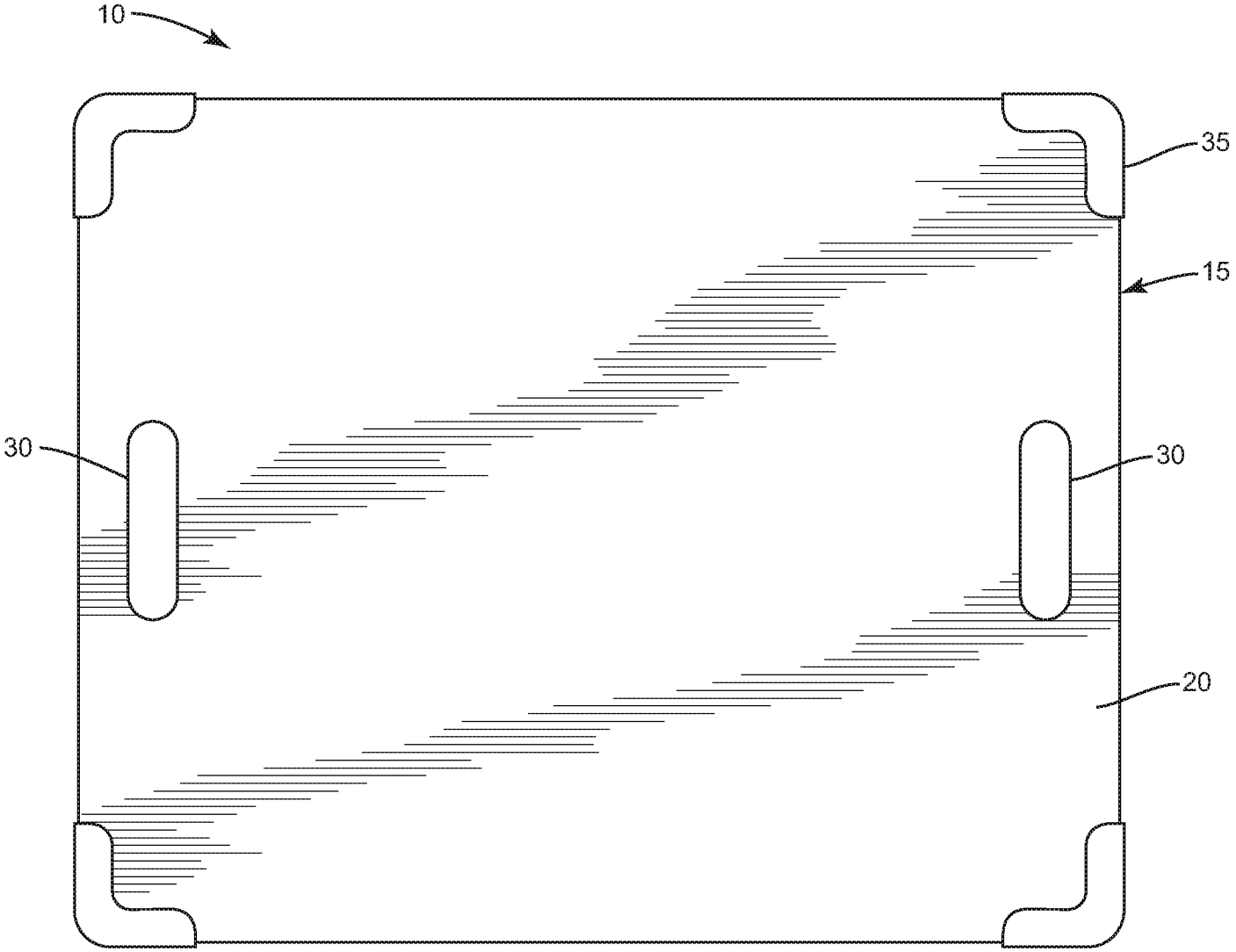
FIG. 3 is a bottom view of the carrying tray.

Referring now to the drawings, a carrying tray 10 according to one embodiment of the invention is shown. The carrying tray 10 comprises a base 15 having a generally planar support surface 20 for supporting food containers. In the embodiment shown in the Figures, the base 15 has a generally rectangular configuration. Those skilled in the art will appreciate that the overall shape of the base 15 is not material to the invention and that the base 15 could be made in other shapes including circular, oval or elliptical.

The support surface includes a plurality of peg openings 25, distributed across the support surface 20. As will be hereinafter described in greater detail, the peg openings 25 receive pegs 60 which are used to prevent the shifting of food containers 70 placed on the support surface 20. A pair of fingerholds 30 are formed at opposite ends of the base 15. A user can insert his or her fingers through the fingerholds 30 to carry the carrying tray 10. In some embodiments, the support surface 20 may also include a channel 65 or recess to catch food that spills during transport.

A storage recess 40 is formed in the support surface 20 and is centrally located in the support surface. In the exemplary embodiment shown in the figures, the storage recess 40 has a generally rectangular configuration sized to accommodate a number of pegs 60. The storage recess 40 includes a finger access extension 45 to allow insertion of a user's fingers to lift the pegs 60 from the storage recess 40. An elastic strap 50 extends across the storage recess 40 to retain the pegs in the storage opening.

In some embodiments, the carrying tray 10 may further include non-skid pads 35 that wrap around the corners of the base 15. The non-skid pads 35 may be made of rubber or thermoplastic material and may be secured in any suitable manner, such as by adhesive. The non-skid pads could also be sized to provide a friction fit with the base 15, thus allowing the non-skid pads to be removed for cleaning.

During use, food containers 70 are placed on the support surface 20. Once the food containers 70 are placed, the pegs 60 are inserted into selected ones of the peg openings 25 to closely surround the food container 70 and prevent the food container 70 from shifting during transportation. It will be readily apparent to those skilled-in-the-art that the peg openings 25 can accommodate food containers 70 of different sizes.

The carrying tray could be used to carry a variety of articles in addition to food containers, such as flower vases, potted plants, or similar articles that can spill during transport.

What is claimed is:

1. A carrying tray comprising:

a base including a support surface configured to support articles to be transported;

a plurality of peg openings formed in said support surface;

a plurality of pegs for insertion by a user into selected ones of said peg openings during use of the carrying tray to restrain one or more articles supported on said support surface;

a generally rectangular storage recess formed in said support surface for storing said pegs when said carrying tray is not in use, said storage recess configured to store the pegs in side-by-side relationship;

a finger access extension protruding from one side of the storage recess configured to allow insertion of the user's fingers into the storage recess to retrieve the storage pegs;

a strap having ends secured to the support surface on opposing sides of the storage recess and extending across said storage recess to retain said pegs in said storage recess; and a channel formed in the support surface configured to catch food that spills during transport, said channel at least partially surrounding the storage recess.

2. The carrying tray of claim 1 wherein the storage recess is centrally located in the support surface and wherein the peg openings surround the storage recess.

3. The carrying tray of claim 1 further comprising fingerholds on opposing ends of said carrying tray.

4. The carrying tray of claim 1 wherein the support surface is generally rectangular.

5. The carrying tray of claim 1 wherein the base comprises a single piece.

* * * * *